US007629894B2

(12) United States Patent
Plocher et al.

(10) Patent No.: US 7,629,894 B2
(45) Date of Patent: Dec. 8, 2009

(54) METHODS AND SYSTEMS FOR CONTROLLING DIRECTIONAL SOUNDERS FOR ROUTE GUIDANCE

(75) Inventors: Thomas A. Plocher, Hugo, MN (US); Janet J Z X Jin, Shanghai (CN); Foong Yeen Chan, Shanghai (CN); Qing Li, Shanghai (CN)

(73) Assignee: Honeywell International Inc., Morristown, NJ (US)

( * ) Notice: Subject to any disclaimer, the term of this patent is extended or adjusted under 35 U.S.C. 154(b) by 221 days.

(21) Appl. No.: 11/447,376

(22) Filed: Jun. 6, 2006

(65) Prior Publication Data

US 2007/0279242 A1 Dec. 6, 2007

(51) Int. Cl.

| | |
|---|---|
| ***G08B 25/08*** | (2006.01) |
| ***H05B 39/00*** | (2006.01) |
| ***H04R 27/00*** | (2006.01) |

(52) U.S. Cl. ..... 340/692; 340/286.11; 340/331; 340/332; 340/384.71; 340/628; 381/82

(58) Field of Classification Search ..... 340/692
See application file for complete search history.

(56) References Cited

U.S. PATENT DOCUMENTS

| | | | | |
|---|---|---|---|---|
| 6,201,470 | B1 * | 3/2001 | Withington | 340/384.7 |
| 2005/0128070 | A1 | 6/2005 | Faltesek | |
| 2006/0071802 | A1 | 4/2006 | Right et al. | 340/628 |

OTHER PUBLICATIONS

System Sensor®, "ExitPoint Directional Sounder" Product Overview including 'Applications Guide', Models Available PF24, © 2005, 53 pages.

System Sensor®, "ExitPoint Directional Sounder" Applications Guide, Nov. 2004, © 2004, 26 pages.

* cited by examiner

*Primary Examiner*—Donnie L Crosland
(74) *Attorney, Agent, or Firm*—Husch Blackwell Sanders Welsh & Katz

(57) ABSTRACT

A plurality of directional sounders located in a region being monitored can be synchronously and sequentially activated in various patterns to establish an audibly defined exit route from the region. Emitted audio, from a respective sounder, can be different than the audio emitted by other activated sounders to provide a path and direction for evacuation to individuals in the vicinity of the exit route.

19 Claims, 4 Drawing Sheets

METHODS AND SYSTEMS FOR CONTROLLING DIRECTIONAL SOUNDERS FOR ROUTE GUIDANCE

FIELD

The invention pertains to systems and methods for assisting individuals in exiting a region. More particularly, the invention portions to systems and methods which generate exit route identifying audio signals for use by individuals in a region being monitored.

BACKGROUND

Known directional sounder devices, for use in fire alarm and evacuation systems, generate broad band directional sound so as to help the evacuees more accurately locate the location of an emergency exit. Known forms of these devices are not addressable. In one configuration, they are located at emergency exit doors in the vicinity of illuminated EXIT signs. In this configuration, they can be used as redundant exit indicators. Alternately they can be mounted along an exit path.

One form of a directional sounder is marketed by the System Sensor Division of Honeywell International under the brand name "Exit Pointe". Other broad brand directional sounders are also available in the market place. When activated members of groups of such device operate in a non-synchronized fashion to help define evacuation or output paths.

There continue to be ongoing needs to more effectively direct evacuees along emergency evacuation paths. It would be desirable to be able to not only provide identifying indicia as to the location of the path or paths, and provide a sense of direction along the path(s), but also to be able to dynamically change the path or paths in response to ongoing emergency conditions. For example, as a fire spreads it may be desirable to substantially change the identified evacuation path or paths so as to direct people away from the spreading fire, even though the result may be that the path length itself increases.

It would also be desirable to be able to use known types of directional sounders in ways that increase the value of the output sound to persons in need of a evacuating a region.

DETAILED DESCRIPTION

Figure 1:
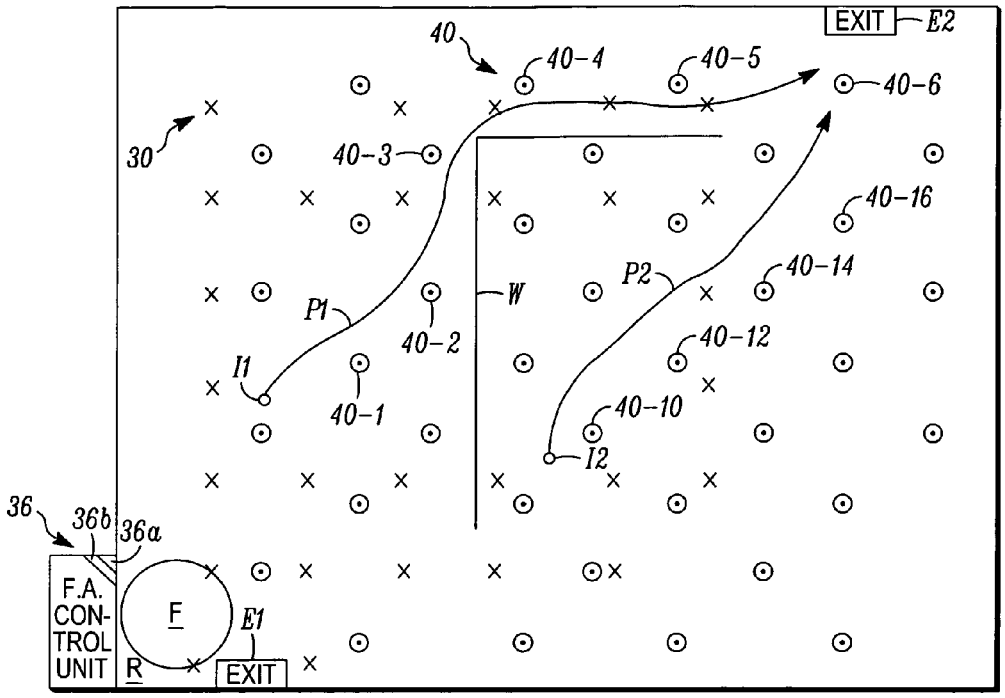
FIG. 1 is a plan view of a region wherein a system in accordance of the invention has been installed.

While this invention is susceptible of embodiment in many different forms, there are shown in the drawing and will be described herein in detail specific embodiments thereof with the understanding that the present disclosure is to be considered as an exemplification of the principles of the invention and is not intended to limit the invention to the specific embodiments illustrated.

In accordance with the invention, directional sounders can be activated to provide coordinated audible patterns so as to assist individuals wishing to evacuate from a region travel along an evacuation path to a safe exit. In one aspect of the invention, activation signals can be sent to each member of plurality of directional sounders by a regional monitoring or fire safety network. Synchronized audio patterns can then be emitted. In a disclosed embodiment, these can be at least in part simultaneously output from a plurality of sounders. Preferably, sounders will be energized to emit outputs in multiples of a beat set by one member of the plurality. Sounders can be activated so as to emit audio at an increasing output rate along an evacuation path.

In another aspect of the invention, synchronized sequential patterns can be emitted from the members of a plurality of sounders. As the evacuee travels along the evacuation route, the audio indicia not only increase in rate along the path leading toward the exit, emissions from those members of a plurality at or adjacent to the proximal end of the path can cease while the emissions at the distal end of the path, heading toward the exit, continue with an increasing rate.

In yet another aspect of the invention adjacent sounders can be driven so as to always emit overlapping audio outputs at varying rates to guide the evacuee towards the exit. In accordance with the invention, pauses can be introduced in to the audible output sequence so as to provide separation for the emissions between temporally adjacent sounders. Pauses can be silent. Alternately, they can be, at least in part, filled with verbal instructions and/or information.

The directional sounders can be addressable in one aspect of the invention. Alternately, all of the sounders can be identical, without addressability. In this embodiment they can be selectively controlled using either individual control cables or, add-on wired or wireless address units which provide the required control signals to the respective sounder.

FIG. 1 is a top plan view of a region R where a system 10 which embodies the invention has been installed. The region R includes two Exits E1, E2, which are spaced apart from one another as well as a plurality of ambient condition detectors 30.

The members of the plurality, such as 30*i* can be installed throughout the region R in an arbituary fashion. Representative types of detectors include smoke detectors, gas detectors, fire detectors and the like all without limitation.

The members of the plurality 30 can be in wired or wireless communication with a fire alarm monitoring control unit indicated generally at 36. The unit 36 is in the vicinity of the region R.

One form of a directional sounder is marketed by the System Sensor Division of Honeywell International under the brand name "Exit Pointe". Other broad brand directional sounders are also available in the market place. When activated member of groups of such device operate in a non-synchronized fashion to help evacuation or output paths. It will be understood that the Region of FIG. 1 is merely representative and illustrative. A system such as a system 10 can be installed in a single floor of facilities or buildings, as well as multi-floor buildings or facilities, or, underground regions such as mines, all without limitation.

The fire alarm monitoring control unit 36 is of a type which would generally be known to those of skill in the art. It might include one or more programmable processors 36*a* which execute control or monitoring software 36*b*. Additionally, the communications between the members of the plurality 30 and the control unit 36 would also be of a type generally known to those of skill in the art and need not be discussed further.

A plurality of directional sounders, indicated generally at 40 is also installed in the region R. It will be understood that the directional sounders, such as sounder 40*i*, might be the same as or comparable to the EXIT POINTE directional sounders noted above marketed by System Sensor Division of Honeywell International Inc. The members of plurality 40, for example, member 40*i* can be energized by and operated under the control of the unit 36. Control can be effected wired or wirelessly all without limitation and all such configurations come within the scope of the invention.

As illustrated in FIG. 1, the region R includes a generally L shaped wall W which extends through portions thereof. Some of the members of the plurality 30 are on one side of the wall W and others are on a different side of the wall W. Some members of the plurality of directional sounders 40 are on one side, some are on the other side of the wall W.

The system 10 responds to a circumstance where a fire F has been detected by one or more members of the plurality 30 generally in a vicinity of the exit door E1. As described in more detail subsequently, while the individuals I1 and I2 in the region R are actually physically closer to the Exit E1, safer and more appropriate exit routes for them from the region R are via the exit door E2.

In accordance with the present method and system 10, directional sounders such as the group of sounders including 40-1, -2 . . . -6 can be energized, as discussed in more detail subsequently, to define an audible escape path P1 for the individual I1 toward the exit E2. Alternately, a different path P2 can be audibly presented to the individual I2 by activating the sounders 40-10, 12, 14, 16 and sounder 40-6 to lead the individual I2 to audibly toward the exit E2.

It will be understood in accordance with the method and system 10 that the exact spacing of the members of the plurality 40 would be known to those in skill of art and would not represent a limitation of the present invention. The exact number of the members of the plurality 40 would also not represent a limitation of the present invention.

Figure 2:
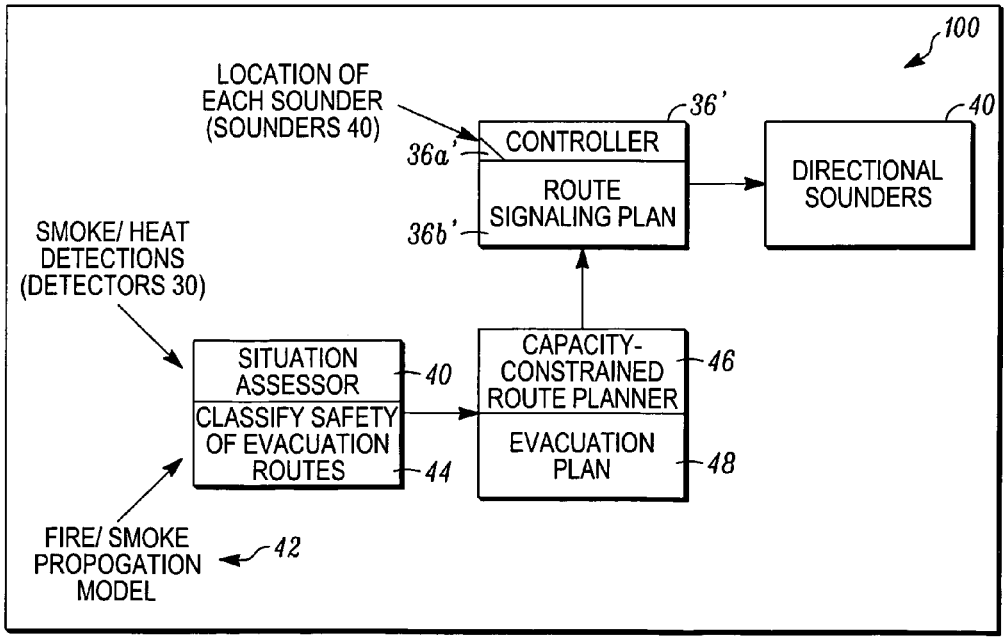
FIG. 2 illustrates a flow diagram and aspects of a method in accordance with the invention.

In accordance with the method and system 10 of FIG. 1, FIG. 2 illustrates a block diagram of adaptive evacuation method and system 100.

In response to information concerning a developing small fire, or alarm condition from the detectors 30 a situation assessor 40, which also can take into account a fire/smoke propagation Model 42 can assess the safety of a variety of evacuation routes in a region R of interest, such as the region R.

A route planner 46, taking into account what might be a prestored evacuation plan 48 in responsive to the safety classification 44 of various evacuation routes in the region R of interest establishes an acceptable evacuation plan having appropriate exit routes from those regions R of a building, offices, conference rooms and the like.

A controller 36', which could be the same as the fire alarm monitoring and control unit 36, or a different processor as desired, responds to one or more appropriate evacuation plans 48 to generate a route signaling plan 36*b'* using control software 36*a'*.

The controller 36' takes into account location information of each of the members of the plurality 40 for example in the region R as well as the family of audible sound patterns which each such unit can emit. The subsequent route signaling plan 36*b'* can then be executed in a coordinated manner by forwarding activation signals to the members of the plurality 40, for example.

FIGS. 3-7 illustrate alternative, coordinated, sound patterns which the sounders 40 can be driven to emit by the controller 36' in defining evacuation paths, such as the path P1 and the path P2.

Figure 3:
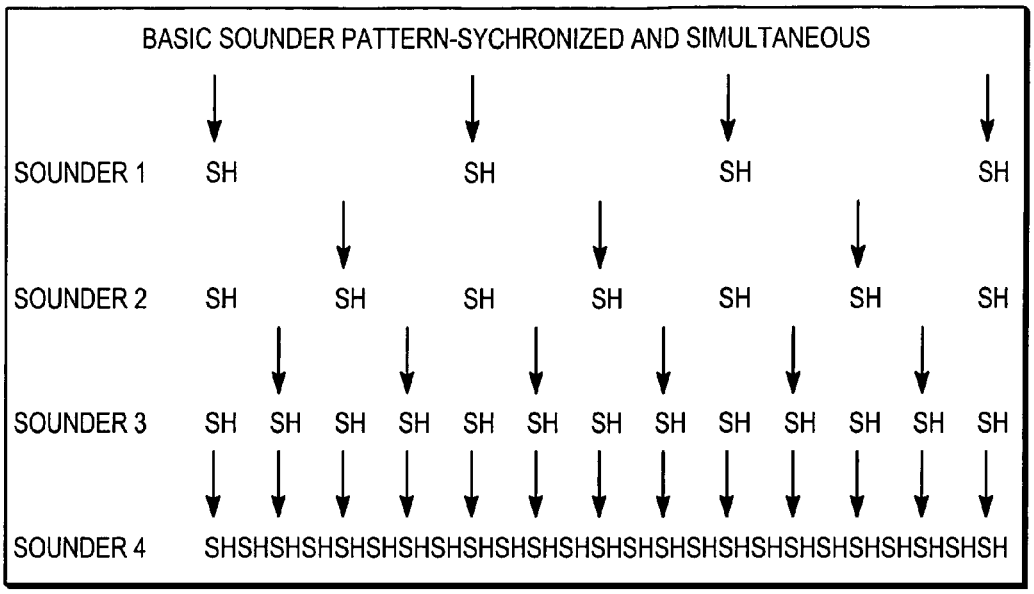
FIGS. 3-7 illustrate various exemplary evacuation path defining audio output sequences in accordance with the invention.

FIG. 3 illustrates one form of a synchronized and simultaneous sounder output pattern in accordance with the invention. For exemplary purposes only, outputs from four sounders are illustrated. More or fewer sounders could be used to define an evacuation path without departing from the scope of the invention. Sounder 1 is further from the exit than is sounder 4.

In accordance with the pattern of FIG. 3, representative sounders such as 40-10, -12, -14, -16, can be activated in multiples of a beat set by the sounder 40-10. The representative multiple is two times the beat of the prior sounder. Thus, sounder 2 emits two output patterns during the same time interval that local sounder 1 emits only a single pattern. It will be understood that any multiple could be used without departing from the scope of the invention. The pattern is continually repeated. Alternately, the order of the activation could be reversed so that a local sounder emits audio at a faster rate then subsequent sounders (closer to the exit) which emit output bursts at a lower rate.

Figure 4:
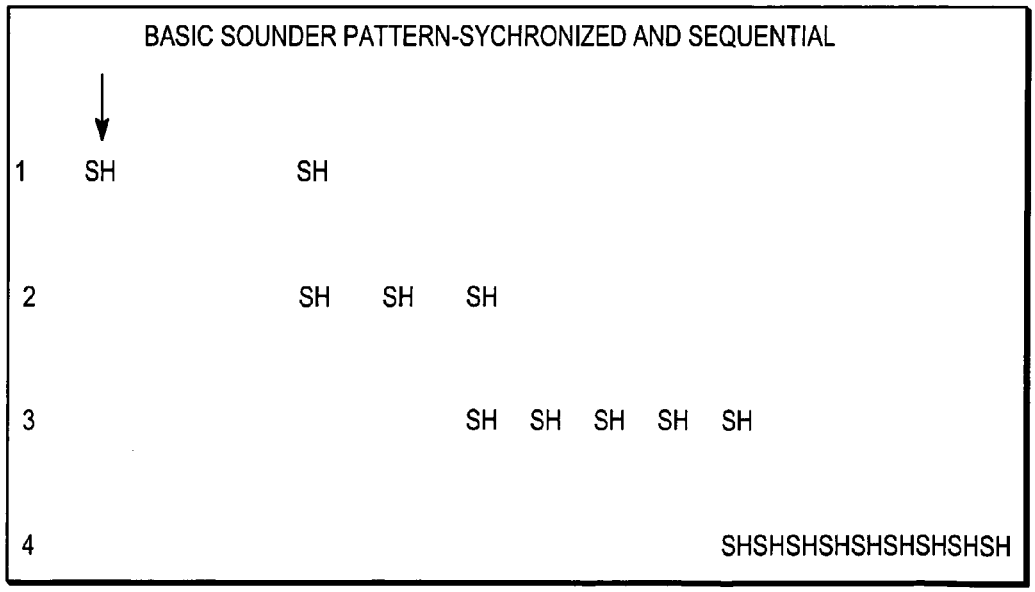

FIG. 4 illustrates an alternate sounder pattern. In the pattern of FIG. 4, the members of the plurality not only emit output patterns at increasing rates, but the outputs are synchronized to overlap one another and are emitted sequentially. When sounder 4 concludes its output, the pattern is repeated.

Figure 5:
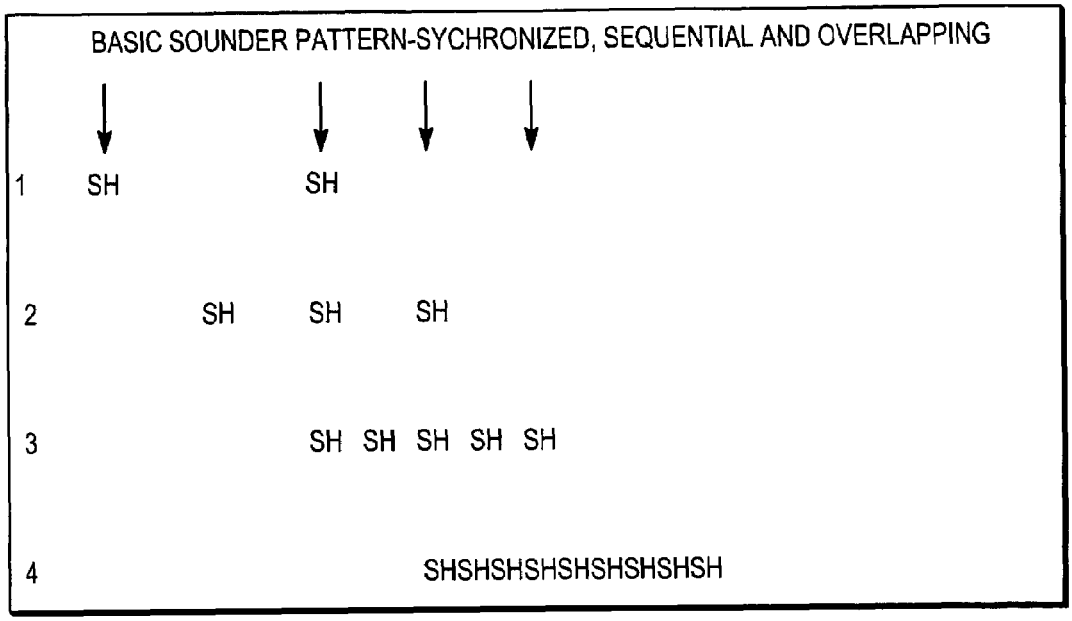

FIG. 5 illustrates yet another sounder output pattern in accordance with the invention. In the pattern of FIG. 5 each sounder, always emits at least one audio output burst in synchronism with the output of another sounder. There is as a result always an overlap between two or three of the sounders based on the beat pattern established by the sounder 1. When the pattern has been completed, once sounder 4 has finished emitting its outputs, it is repeated.

Figure 6:
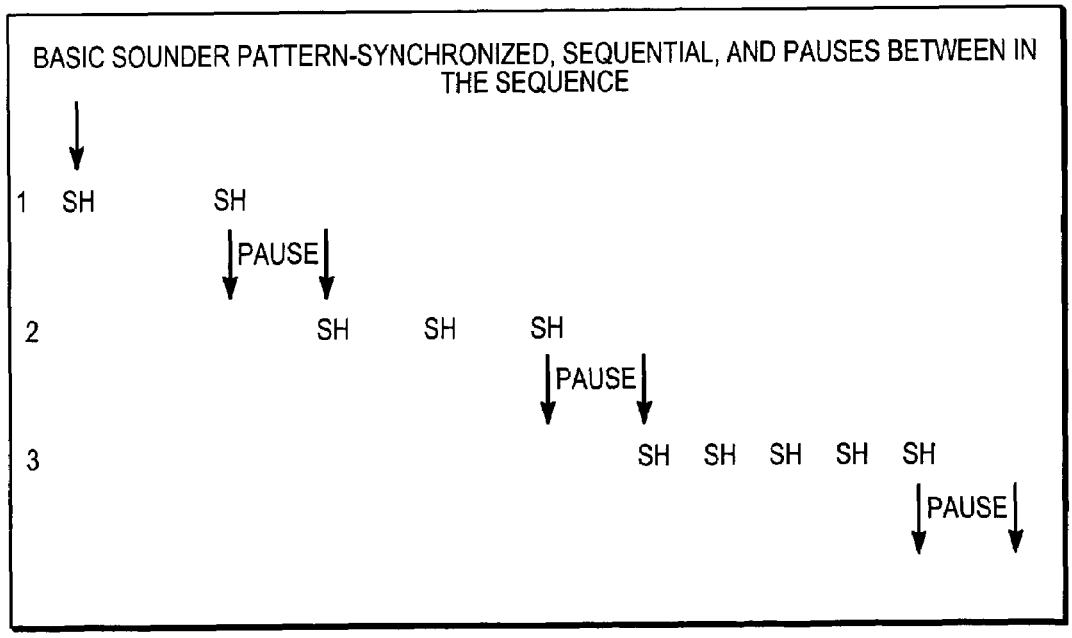

FIG. 6 illustrates another set of sounder patterns in accordance with the invention. In the patterns of FIG. 6, on each of the later sounders is synchronized with the beat set by the sounder 1. A pause is provided between the patterns of respective sounders, independent of the burst rate of two temporally adjacent sounders. The pause is a fixed time interval. Once the last sounder in the sequence has completed emitting its set of outputs, the pattern is repeated. As noted above, any number of sounders can be coupled into a sequential pattern as in FIG. 6.

Figure 7:
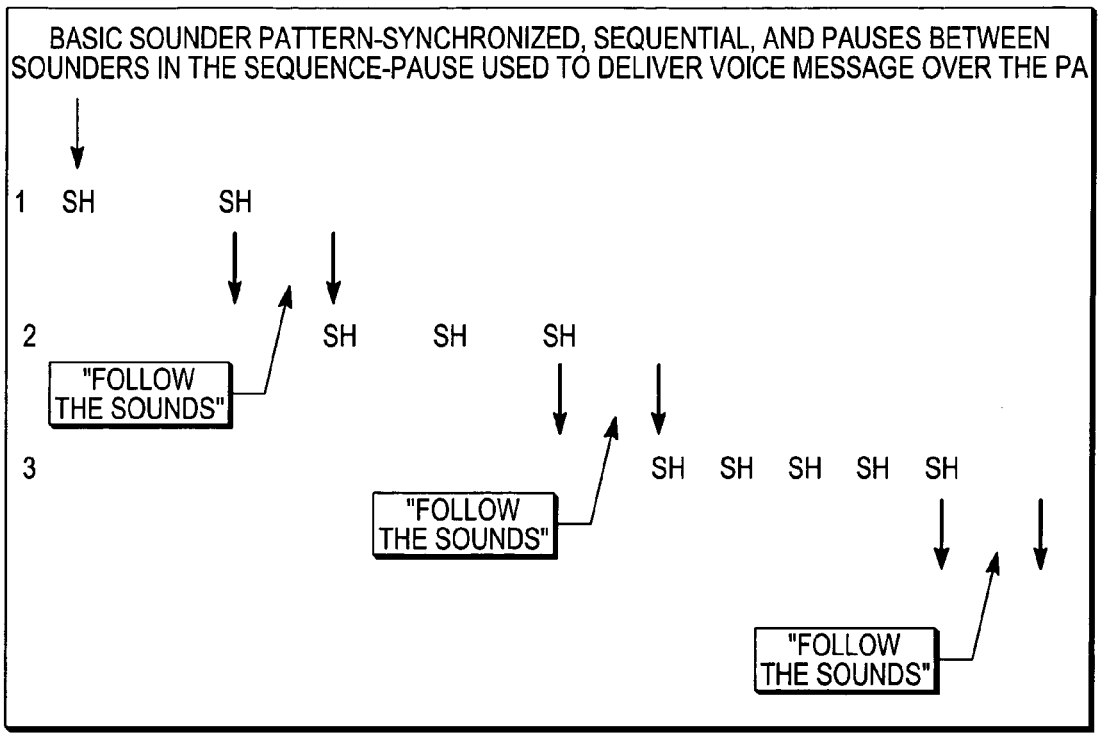

FIG. 7 illustrates yet another pattern. In FIG. 7, instead of the pauses being silent, as in FIG. 6, voice can be injected into the intervals between groups of emissions from temporally adjacent sounders to provide encouragement, support and direction to the individuals in the region R attempting to follow the path or paths to a safe exit. Once again the sequence of FIG. 7 can be repeated after the last sounder in the sequence has completed its emissions.

From the foregoing, it will be observed that numerous variations and modifications may be effected without departing from the spirit and scope of the invention. It is to be understood that no limitation with respect to the specific apparatus illustrated herein is intended or should be inferred. It is, of course, intended to cover by the appended claims all such modifications as fall within the scope of the claims.

The invention claimed is:

1. A method comprising:

assessing a plurality of evacuation routes from a region for safety;

selecting an escape route from the plurality of evacuation routes; and synchronously activating a plurality of directional sounders along the escape wherein different directional sounders are activated to emit synchronized audio bursts at different times during a repeating cycle to form a traveling audible indicator along the escape route where directional sounders relatively nearer to the region of safety have a higher repetition rate than directional sounders relatively further from the region of safety during each cycle of the repeating cycle.

2. A method as in claim 1, where the sounders emit an output sequentially along the escape route.

3. A method as in claim 2 where sequential emission includes sequentially altering an audio parameter of sounders along the escape route.

4. A method as in claim 3 where altering includes altering an activation rate along the escape route.

5. A method as in claim 1 which includes sensing at least one type of alarm indicating ambient condition.

6. A method as in claim 5 which includes, responsive to sensed conditions, selecting a second escape route from the plurality of evacuation routes.

7. A method as in claim 6 where the sounders are activated sequentially along the second escape route.

8. A method as in claim 7 where sequential activation includes sequentially altering an audio parameter of sounders along the second escape route.

9. A method as in claim 8 where altering includes altering an activation rate along the second escape route.

10. A method as in claim 5 which includes sensing the ambient condition at a plurality of spaced apart locations in the region.

11. A method as in claim 10 where sensing includes sensing at least one of smoke, gas, fire, temperature, flowing water, or air quality.

12. A method as in claim 1 further comprising:

subsequently assessing a second plurality of evacuation routes from a region for safety responsive to a varying ambient condition;

selecting a second escape route from the second plurality of evacuation routes; and synchronously activating a second plurality of directional sounders along the second escape route wherein different directional sounders are activated to emit synchronized audio bursts at different times to form a traveling audible indictor along the second escape route.

13. A method as in claim 1 wherein first and second pluralities of audio bursts are separated by speech carrying intervals between the first and second pluralities of audio bursts.

14. A system comprising:

a plurality of directional sounders, the sounders, when installed in a region being monitored, can be synchronously activated to provide audio feedback in the region; and a control unit coupled to the sounders, the control unit assesses a plurality of evacuation routes from the region for safety, selects one exit path from the plurality of evacuation routes, and causes the sounders to emit a plurality of selected audio patterns during a repeating cycle which vary along and specify the exit path where sounders relatively nearer to the region for safety have a higher repetition rate than sounders relatively further from the region for safety during each cycle of the repeating cycle.

15. A system as in claim 14 wherein the control unit assesses a second plurality of evacuation routes from the region for safety responsive to a varying ambient condition, selects a second exit path from the second plurality of evacuation routes, and causes the sounders to emit a second plurality of selected audio patterns which vary along and specify the second exit path.

16. A system as in claim 14 where the patterns include at least one of variable frequencies, overlapping audio outputs, pattern-synchronized audio outputs, sequential audio outputs, or synchronized audio outputs with intervals therebetween.

17. A system as in claim 14 which includes a plurality of ambient condition detectors which, when coupled to the control unit, provides ambient condition indicia thereto.

18. A system as in claim 17 which includes software, executed by the control unit and responsive to at least some of the indicia to establish an activation sequence for at least some of the sounders thereby establishing the exit path.

19. A system as in claim 16 where at least some of the intervals are silent, others can include speech.

* * * * *